US005338126A

United States Patent [19]

Mullin et al.

[11] Patent Number: 5,338,126

[45] Date of Patent: Aug. 16, 1994

[54] HINGE BINDER DEVICE

[76] Inventors: Howard Mullin, 86 Kilroy Way, Atherton, Calif. 94025; Boyd T. Bessey, 45879 County Rd. 665, Paw Paw, Mich. 49079

[21] Appl. No.: 24,163

[22] Filed: Feb. 26, 1993

[51] Int. Cl.[5] ..... B42F 3/00

[52] U.S. Cl. ..... 402/64; 402/14

[58] Field of Search ..... 402/8, 9, 14, 15, 16, 402/17, 60, 63, 64

[56] References Cited

U.S. PATENT DOCUMENTS

| | | | |
|---|---|---|---|
| 2,012,572 | 8/1935 | Linsky | 402/15 X |
| 4,305,675 | 12/1981 | Jacinto | 402/63 X |
| 4,820,072 | 4/1989 | Nava | 402/64 |

*Primary Examiner*—Mark Rosenbaum
*Assistant Examiner*—Willmon Fridie
*Attorney, Agent, or Firm*—Douglas A. Chaikin

[57] ABSTRACT

Disclosed herein is a hinge binder device for retaining paper goods and the like. The device includes an anchoring member for retaining the goods a locking member for releasably locking the anchoring means. The locking member includes a support member, a wing member, and a hinge for pivotally connecting the support and wing members. Additionally, the locking mechanism includes a release for releasably locking the support and wing members. The anchoring member has leg portions for retaining the goods and the leg portions are adapted for compatible fit between the wing and support members.

9 Claims, 3 Drawing Sheets

HINGE BINDER DEVICE

BACKGROUND OF THE INVENTION

1. Field of the Invention

This invention relates to devices used for carrying paper goods and the like and more particularly to hinge binder devices such as notebooks and ring binders, which retain such paper goods and the like and allow easy access to the goods as well as to adding or subtracting from the volume of goods.

2. Previous Art

Virtually everyone on our planet uses paper. Sheets of paper in the modernized world are essential to virtually any business or other activity. It may be said that the organization of these sheets of paper determines a successful activity from an unsuccessful one.

Various binders have been developed to assist the user in organizing his sheets of paper. There are three-ring binders, relying upon three rings to lock and unlock sheets of paper. There are folders in which loose sheets of paper are bound. Users have even employed papers of all variety and sizes to organize paper.

To a varying degree all of the above and many others not mentioned have been successful. However, each of the known devices have there drawbacks, some quite serious and even painful. For example, a three ring binder has a rigid spine and three rings to hold "loose-leaf" paper. While such binders are quite serviceable in holding papers and allowing the user to add or subtract from the existing paper goods present, such binders typically have metal rings which can pinch a user's hand(s) and even break the skin. Any school child will certainly be able to share experiences about being pinched by such binders.

More recently, plastic binders have been marketed to school children and others, including business people. Such binders do not pinch the user causing injury, but may not have the longevity needed to be effective paper carriers. Additionally, size constraints may also limit such binders effectiveness. Plastics binders typically have more limited ability for holding paper goods such as sheets of paper.

Another binder device includes a single rectangular wrapper formed from a semi-rigid material and further including two parallel fold points. The fold points are arranged to flank a central area such that the outer portions of the wrapper can be folded over the central area and loose papers and the like arranged in the central area will be secured thereby. Again this type of binder device has been shown to have a limited life and not readily adapted for carrying large quantities of paper goods.

What is needed is a binder device that will effectively secure loose documents in bound book-like arrangement that will allow convenient removal and addition and installation of paper goods, such as sheets of paper. This device should also have considerable longevity and be easy to use for people of all ages from school children to sophisticated business persons and everyone in between.

SUMMARY OF THE INVENTION

It is an object of this invention to provide a simple, easy to use binder device that is capable of having paper goods added to or removed from the device.

It is a further object of this invention to provide such a binder device which is capable of little wear over many release and lock operations.

It is a further object of this invention to provide a cost effective device which can hold even large quantities of paper goods of varying sizes.

In accordance with the above objects and those that will be mentioned and will become apparent below, the hinge binder device in accordance with this invention includes:

- an anchoring means for retaining the goods;
- a locking member for releasably locking the anchoring means, the locking member including:
  - a support member,
  - a wing member,
  - hinge means for pivotally connecting the support and wing member, and
  - means for releasably locking the support and wing members; and
- the anchoring means adapted for compatible fit between the wing and support members, whereby the goods retained by the anchoring means may be retained, added or subtracted to as desired.

In a preferred embodiment, the hinge binder device in accordance with this invention is made from a ductile material such as a plastic or metal. The wing member of the preferred embodiment is divided into two sections and spaced apart. An aligning member is in the spaced apart area between the two wing sections and aligns the wing sections as they are locked in place.

The preferred embodiment additionally includes a release member comprising a set of detentes in the form of cut-outs on each of the support and wing members and abutment members for interlocking friction-fit connection. The members are gripped at the friction-fit abutment members and through cut-outs and opposite pressure is applied to the respective members to facilitate easy release of the anchoring member and thereby the paper goods held by the anchoring member.

An additional preferred embodiment includes a series of male and female elements on the opposed faces of the wing and support members for locking the members to each other. The male and female elements on the opposed faces are sized and shaped for compatible mating fit. Additionally, the male elements include an oblique shaped edge defining a ridge for additional locking support of the members.

It is an advantage of this invention to provide a simple to use yet highly effectively hinge binder device which is designed to have extraordinary longevity which is extremely cost effective to make and sell.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
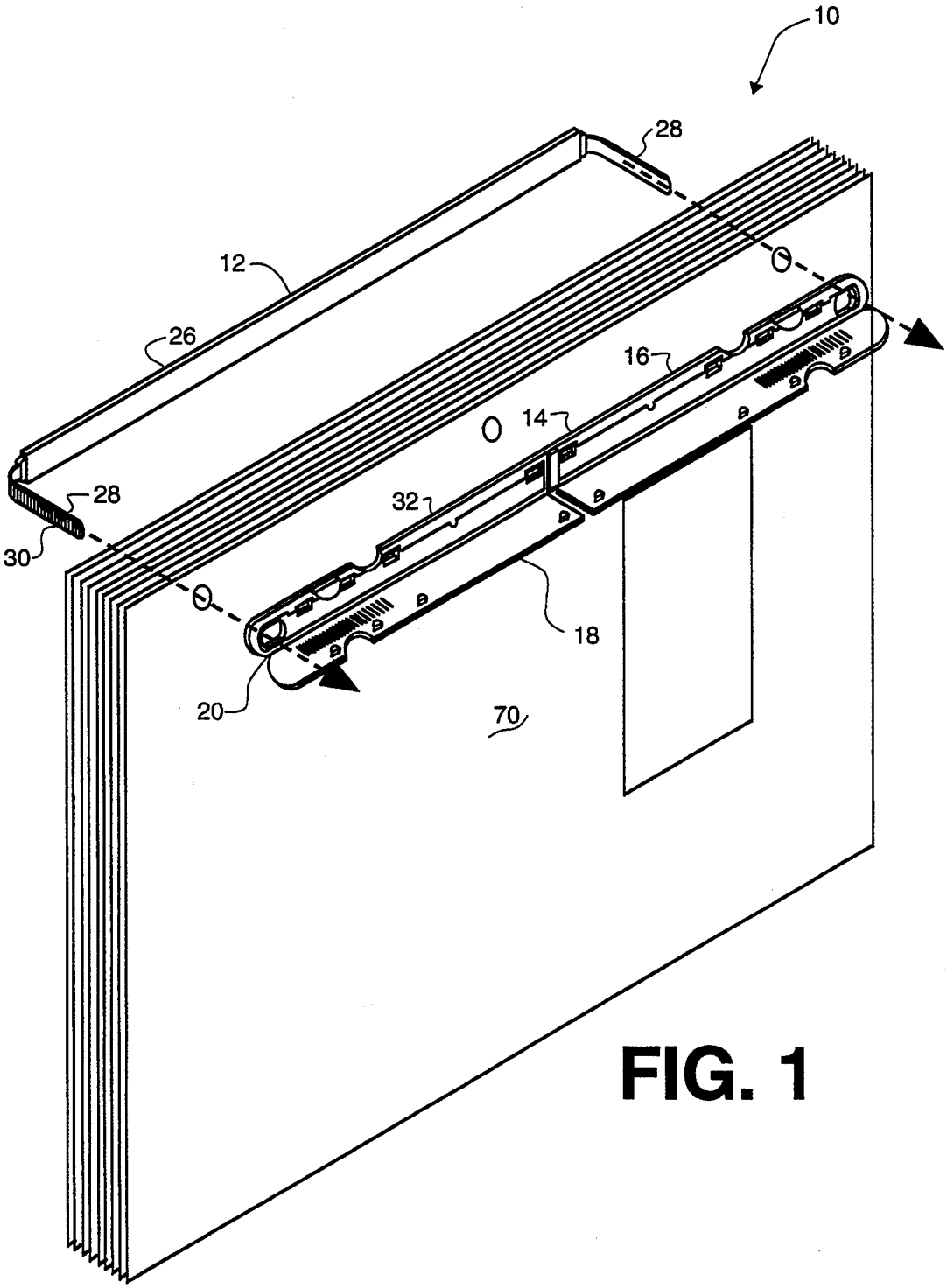
FIG. 1 is an elevated perspective view of the hinge binder device in accordance with this invention.

The invention will now be described with respect to FIG. 1, which illustrates the hinge binder device denoted generally by the numeral 10. The hinge binder device 10 includes an anchoring member 12 and a locking member 14.

The locking member 14 has a support member 16 and a wing member 18. A hinge 20 is formed between the members 16 and 18. The hinge 20 defines a "living hinge". The living hinge 20 is so defined because of its elastic properties. The hinge 20 can be used over and over again with virtually no wear, thereby giving the hinge binder device 10 an extremely long life time.

The hinge 20 pivotally connects the support and wing members, 16 and 18, respectively. As set forth above, a virtually unlimited number of pivoting operations of the members 16 and 18 may take place because the hinge 20 allows the members 16 and 18 to be used without apparent wear. Again, this adds great longevity to the hinge binder device 10.

The hinge 20 in the preferred embodiment shown is not solid. Rather, as shown by the areas 21 in FIGS. 2 and 3, the hinge 20 is formed by selective connection of the members 16 and 18. Formed this way, the hinge 20 defines a slotted hinge.

The slotted hinge 20 also defines a limit barrier. As a result of the slots 21, the degree of pivot rotation is restricted to approximately 210°. By limiting the amount of pivot rotation, the longevity of the hinge binder device 10 is enhanced.

In the preferred embodiment, the locking member 14 is formed as a single piece. The locking member 14 is injection molded and the hinge 20 is formed as part of the locking member 14 as discussed above. The hinge 20 is flush with the members 16 and 18 in the locked position and unnoticeable during any other position. The hinge 20 allows the members 16 and 18 to pivot about the hinge axis approximately 210° because it is integrated within the locking member 14 as shown particularly in FIGS. 2 and 3.

Figure 2:
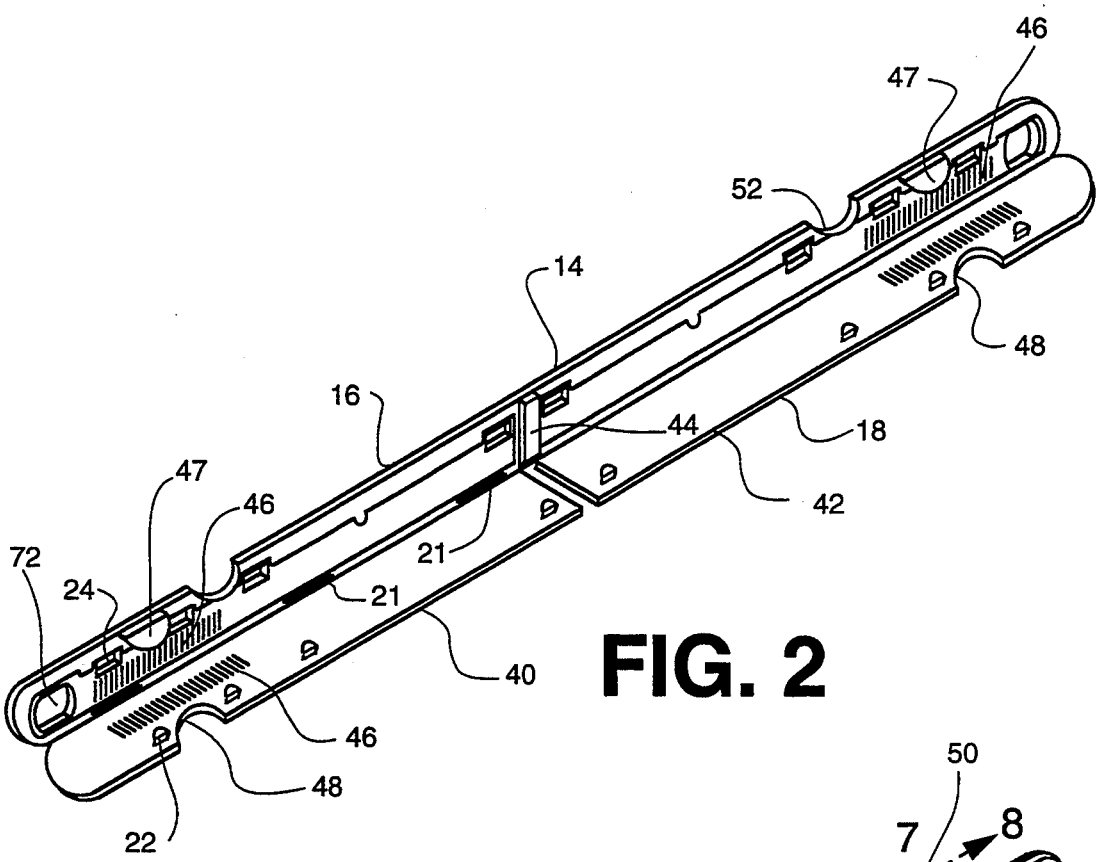
FIGS. 2 and 3 are elevated perspective views of the hinge locking member of FIG. 1.
Figure 3:
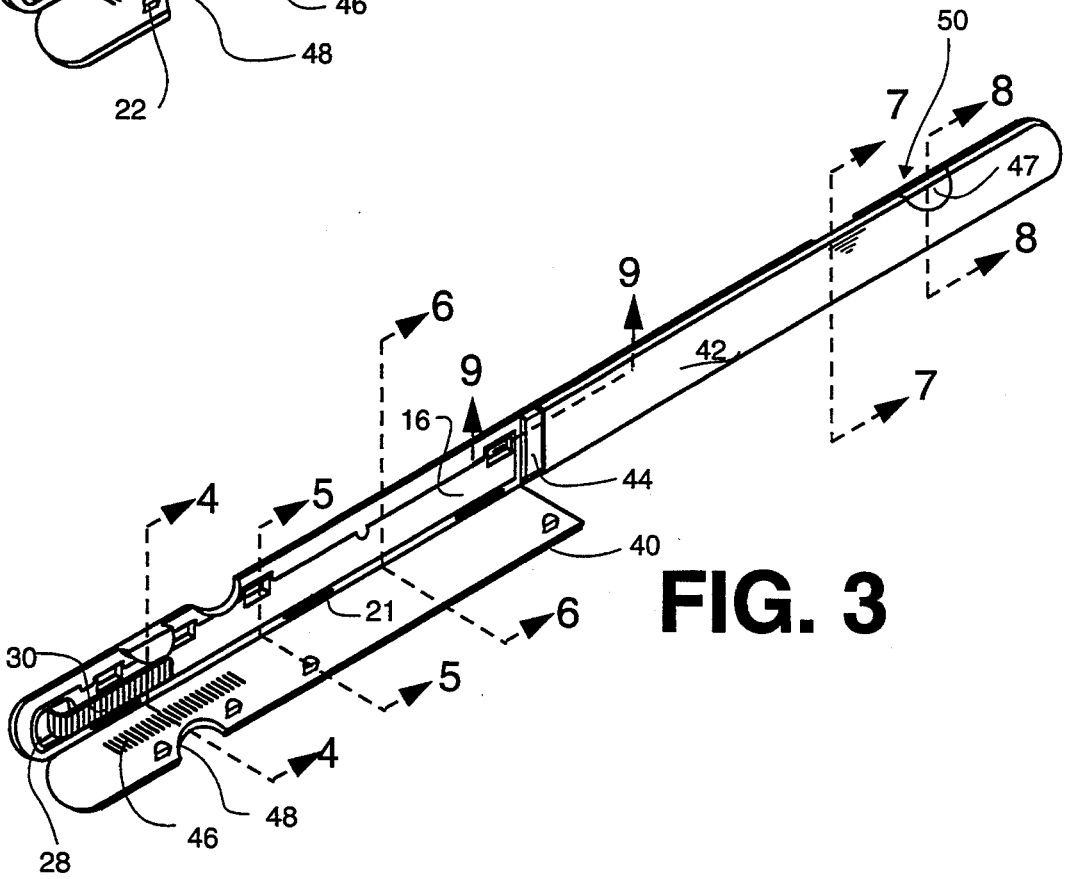
Figure 4:
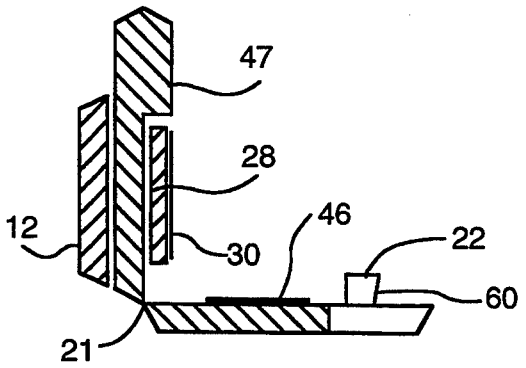
FIG. 4 is an enlarged cross-sectional view of a portion of the locking member illustrating the detail of the abutment member and the detente.
Figure 5:
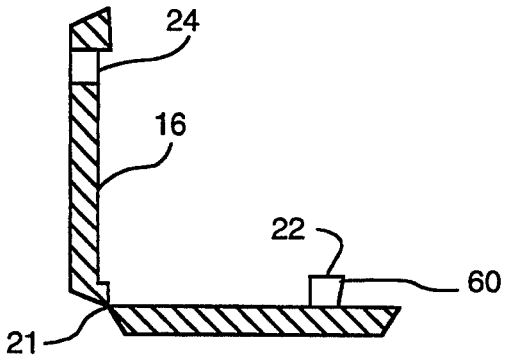
FIG. 5 is an enlarged cross-sectional view of a portion of the locking member illustrating, in detail, namely, the male and female elements along lines 5—5 looking in the direction of the arrows.
Figure 6:
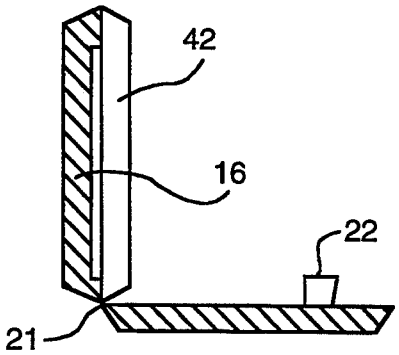
FIG. 6 is an enlarged cross-sectional view of another portion of the locking member, along, lines 6—6 looking in the directions of the arrows.
Figure 7:
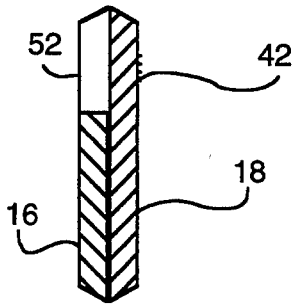
FIGS. 7–9 illustrate various portions of the locking member in the locked position and are views taken along their respective lines looking in the direction of the arrows as indicated.
Figure 8:
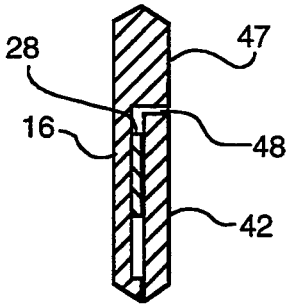

The members 16 and 18 have a plurality of male and female elements, 22 and 24 respectively, designed to releaseably lock together the members 16 and 18 as best illustrated with respect to FIGS. 2 and 3. As will be described below with reference to FIGS. 4–9, the male and female elements, 22 and 24 work cooperatively to releaseably lock together the members 16 and 18 and are thus sized and shaped for compatible fit.

As shown with respect to FIG. 1, the anchoring member 12 has a back portion 26 and leg portions 28. The leg portions 28 define means for supporting, retaining and selectively holding a variable amount of paper goods and the like. The leg portions 28 have an exterior surface with a plurality of teeth 30. The teeth 30 combine with similar teeth on the interior surface of the wing member 18 to create additional friction between anchoring member 12 and the locking member 14 for a more secure locking fit.

It will be appreciated that while not shown, the teeth 30 may also be formed on the interior side of the leg portions 28 within the spirit and scope of this invention. Similarly, the support member 16 may have teeth on its interior surface for mating with the additional teeth on the interior surface of the leg portions 28. This may be useful with large amounts of paper goods.

The anchoring member 12 is approximately 8.5" in length and $\frac{5}{8}$" in width. The leg portions 28 are approximately 2" in length $\frac{3}{8}$" in width. The teeth 30 are spaced apart less than $\frac{1}{8}$" and less than $\frac{1}{8}$" in height. It will, of course, be appreciated that the dimensions herein are necessary to suit the intended use and that other smaller and larger dimensions for other intended uses are all within the spirit and scope of this invention.

The anchoring member 12 is made from polypropylene and its copolymers and alloys. Typically, other materials such as polyethylene, polyesters, nylons and acetals and their copolymers and alloys are believed to be suitable for use as the preferred material from which the anchoring member 12 may be made.

The anchoring member 12 may also be made from a variety of different materials provided the materials are generally ductile as well as having elastic properties that are exhibited by the above described materials.

Thus, in addition to the plastics set forth above, the anchoring member 12 may be made from metals which exhibit these properties. Such metals include ductile aluminum, ductile copper, beryllium copper, brass, alumina bronze and the alloys of the above.

Additionally, the locking member 14 and each of its elements, parts and subelements may also be made from similar materials. Additionally, there is no necessity that the materials for the anchoring member 12 and the locking member 14 be the same. In fact, one of the members may be plastic while the other is metal within the spirit and scope of this invention.

Additionally, the members 12 and 14 may also be made from a semi-rigid material such as PVC, EVA and generally, all thermoplastic elastomers; again within the spirit and scope of this invention. Additionally, the anchoring member 12 may be made from consumer recycled plastic and metal material.

With particular respect to FIGS. 2 and 3, the locking member 14 will be described in detail. The support member 16 and the wing member 18 have opposed interior faces. As described above the opposed face of the wing member 18 has a plurality of projections defining male elements 22; while the opposed face of the support member 16 has a plurality of openings, in the shape of windows, defining female elements 24.

In the preferred embodiment shown in the drawing, the wing member 18 is bifurcated having a first portion 40 and second portion 42. It will be appreciated that the wing member 18 could be broken into any number of portions desired within the spirit and scope of this invention. Bifurcation is chosen because it is easy to install, release and lock. It will be appreciated that a single wing member (not shown) is also within the spirit and scope of the invention.

In bifurcating the wing member 18, the portions 40 and 42 are spaced apart by a spacing element 44 located on the opposed face of the support member 16. The spacing element 44 assists in aligning the wing sections 40 and 42 so that the male and female elements, 22 and 24 respectively aligned for proper locking connection to the support member 16.

Additionally, the wing sections, 40 and 42, each have a plurality of teeth 46 on the opposed face for mating with the teeth 30 and providing additional locking assistance. It will be seen in FIG. 2 that the support member 16 also has teeth 46 to match the teeth 30, when the teeth 30 are on the interior surface of the leg 28, providing additional friction and locking support for the locking member 14.

In order to more securely lock the members, 16 and 18 together and to facilitate release, the locking member 14 is provided with a secondary male element defining an abutment member 47 on each wing section 40 and 42 and compatibly sized and shaped secondary female elements defining a detentes 48. Each of the abutment members 47 is located at the end zones of the support member 16. And, each of the detentes 48 is aligned with the abutment members 47 on the opposed interior face of each of the wing sections 40 and 42.

As will be appreciated by those skilled in the art, either member 16 or 18 can be provided with the male or female elements, 22 or 24, respectively. In the preferred embodiment, both members, 16 and 18 have male and female locking elements so that a secure locking fit between the members 16 and 18 is encouraged.

The locking member 14 includes a release member, shown generally by the numeral 50. The support member 16 has detentes 52 in the form of cut-outs on the support member 16. The detentes 53 are positioned to be adjacent a flat surface of the opposed face of each of the wing sections 40 and 42. The user can then grip the opposed face of the wing sections 40 and 42 while gripping the abutment member 47 and applying force in an opposite direction with the fingers on each of the gripped surfaces, thus easily releasing the locking member 14 from the locked position.

With respect to FIG. 3, there is shown the anchoring member 12 in a partially locked position with the first wing portion 40 in the open position and the second wing member 42 in the locked position. As can be seen from FIGS. 2 and 3, there are no paper goods. If there were paper goods being retained by the binder 10, the leg portions 28 would not, protrude quite so far into the interior of the locking member 14, as illustrated in FIG. 3. And, as a result of the living hinge, the locking member 14 may be opened and locked repeatedly with virtually no wear to the hinge 21. Thereby, enabling the hinge binder device 10 to be extremely durable.

Figure 9:
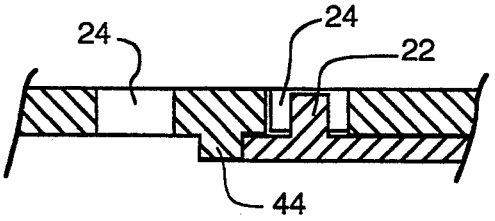

With respect to FIGS. 4–9, there is shown, in detail, the mechanism for locking the locking member 14. It will be seen that each of the male members 22 has a ridge 60. As best seen in FIGS. 4–6, 9, the ridge is formed because the male members 22 have a slightly oblique shape on one side. The ridge 60 is sized and shaped to fit within the female members 24. As a result of the ridge 60 additional resistance is provided which resultants in greater locking strength between the support and wing members 16 and 18. As can be seen in FIG. 9, the ridge is compressed within the female members 24.

As seen in FIGS. 4–9, each of the primary and secondary male and female members fit together in a similar manner, providing a similar friction-type locking fit. It will, of course, be appreciated that other means of fit, such as a snap fit or press fit and similar fits could be adapted within the spirit and scope of the present invention.

In use, goods, such as the paper goods 70 shown in FIG. 1 are be retained by the hinge binder device 10. The leg portions 28 are threaded through holes in the paper goods. Then, the leg portions 28 are threaded through their respective leg openings 72 in the wing sections 40 and 42. The support member 16 may then be locked securely to the support member 16 with the teeth 30 of the leg portions 28 matingly contacting the teeth 46 of the opposed face of the wing sections 40 and 42.

To release the wing member 18 from the locked position, the user simply grips the release member 50 by placing the thumb on the abutment member 47 through the detente 48 and the fore finger on the exposed wing member opposed face through the detente 52. Appropriate pressure is applied by the user in opposite directions and the wing member 18 pivots away from the support member 16 to the released position.

In the released position, the anchoring member 12 may be removed from the locking member 14, thus exposing the leg portions 28. With the leg portions 28 exposed, paper goods such as pages of paper may be easily added or subtracted to the existing goods. The user thus has an inexpensive and efficient structure for carrying paper goods and the like.

While the foregoing detailed description has described several embodiments of the hinge binder device in accordance with this invention, it is to be understood that the above description is illustrative only and not limiting of the disclosed invention. Particularly, a variety of different materials are suitable for use as the hinge binder device in accordance with this invention. It will be appreciated that the type of locking mechanism used could be altered to a press fit or a snap fit also within the scope and spirit of this invention. Thus the invention is to be limited only by the claims as set forth below.

What is claimed is:

1. A hinge binder device for retaining paper and the like goods, comprising:
- anchoring means for retaining the goods, the anchoring means including:
  - a back portion,
  - page support means, the page support means having first friction means;
- a locking member for releasably locking the anchoring means, the locking member including:
  - a support member,
  - a wing member,
  - hinge means for pivotally connecting the support and wing members, the hinge means being made from ductile material and being ductile, and
  - means for releasably locking the support and wing members;
- the anchoring means being adapted for compatible fit between the wing and support members; and
- the wing member having second friction means adapted for compatible mating contact with the page support means for encouraging a releasable locking fit between the anchoring means and the locking member,
- whereby the goods retained by the anchoring means may be retained, added to or subtracted from as desired.

2. A hinge binder device for retaining paper and the like goods, comprising:
- anchoring means for retaining the goods;
- a locking member for releasably locking the anchoring means, the locking member including:

a support member, a wing member, hinge means for pivotally connecting the support and wing members, and a plurality of interlocking female and male elements adapted for releasably locking the support and wing members; and the anchoring means adapted for compatible fit between the wing and support members, whereby the goods retained by the anchoring means may be retained, added to or subtracted from as desired.

3. A hinge binder as set forth in claim 2, wherein the female elements are located on one of the wing or support members and the male members are located on the other of the members.

4. A hinge binder device as set forth in claim 2, wherein the female members are in the shape of windows and the male members are projections having ridges at the connection area between the male and female members.

5. A hinge binder device as set forth in claim 4, wherein the support and wing members include a release means for assisting in releasing the members when the members are in a locked position.

6. A hinge binder device as set forth in claim 5, wherein the release means includes the one of the support or wing members having a detente so that the surface of the opposing face is grippable.

7. A hinge binder device as set forth in claim 4, wherein the locking means includes the one member having the male elements having a detente and the other member having the female elements having an abutment member for interlocking friction fit connection.

8. A hinge binder device as set forth in claim 7, wherein the abutment member includes a ridge for locking the detente in secure connection to the abutment member.

9. A hinge binder device for retaining paper and the like goods, comprising:

anchoring means for retaining the goods;

a locking member for releasably locking the anchoring means, the locking member including:

a support member, a wing member, the wing member including at least two sections, the wing member sections being spaced apart, hinge means for pivotally connecting the support and wing members, the support and wing members having interior opposing faces, the faces including means for releasably locking the support and wing members, and alignment means for aligning the wing member sections for releasable locking, the alignment means being positioned in between the wing member sections; and the anchoring means adapted for compatible fit between the wing and support members, whereby the goods retained by the anchoring means may be retained, added to or subtracted from as desired.

* * * * *